United States Patent [19]

McLoughlin

[11] Patent Number: 4,484,171

[45] Date of Patent: Nov. 20, 1984

[54] SHIELDED TRANSFORMER

[76] Inventor: Robert C. McLoughlin, 4414 Alhambra, San Diego, Calif. 92107

[21] Appl. No.: 467,740

[22] Filed: Feb. 18, 1983

[51] Int. Cl.[3] ..... H01F 15/04

[52] U.S. Cl. ..... 336/84 R; 336/84 C; 336/178

[58] Field of Search ..... 336/83, 84 C, 84 R, 336/178, 212; 174/35 CE

[56] References Cited

U.S. PATENT DOCUMENTS

| | | | |
|---|---|---|---|
| 2,114,189 | 4/1938 | Kronmiller | 336/84 C X |
| 2,229,373 | 1/1941 | Cole | 336/84 C X |
| 4,089,049 | 5/1978 | Suzuki et al. | 336/84 C X |

FOREIGN PATENT DOCUMENTS

| | | | |
|---|---|---|---|
| 630204 | 11/1927 | France | 336/84 C |

*Primary Examiner*—A. D. Pellinen
*Assistant Examiner*—Susan A. Steward
*Attorney, Agent, or Firm*—Laurance E. Banghart; Allan M. Lowe

[57] ABSTRACT

A shielded transformer of the type particularly used as an isolation transformer, has a greatly reduced inter-winding capacitance. Metallic overlap is provided, completely across a juncture of the metallic shield with faces of the windows in the core, and completely across a juncture of the metallic shield with the metallic case. This metallic overlap is tolerant to misalignments and variations in fit, completely eliminating gaps that cannot be economically made small with the butt joint of present art. The overlap comprises grooves in faces of the window or in the case. In a second embodiment, the overlap comprises grooves in channels on faces of the window and on the case. The shield fits into the grooves.

8 Claims, 16 Drawing Figures

FIG. 7a
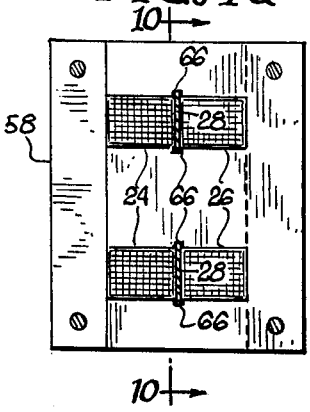
FIG. 8a
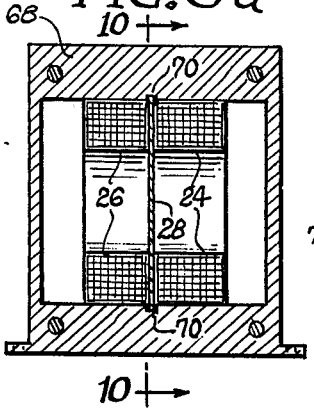
FIG. 9a
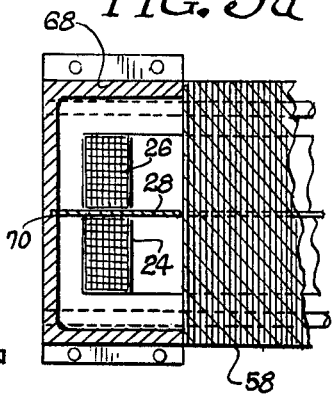
FIG. 7b
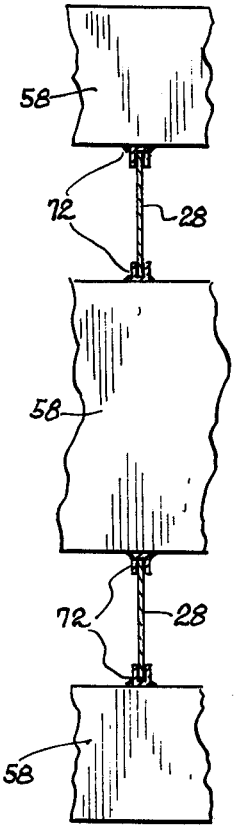
FIG. 8b
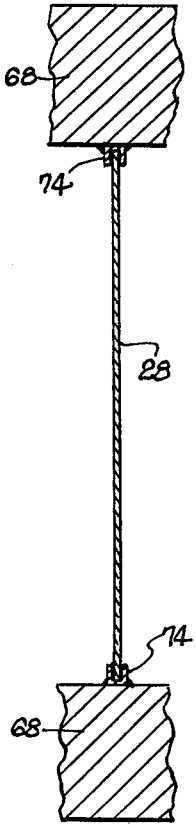
FIG. 10
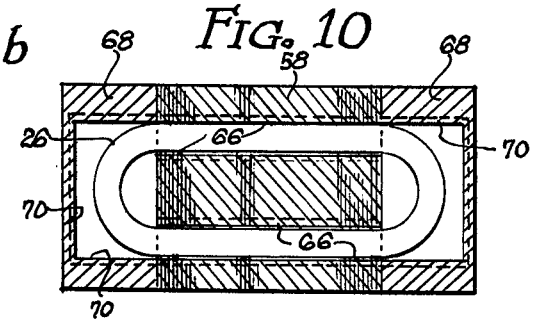
FIG. 11
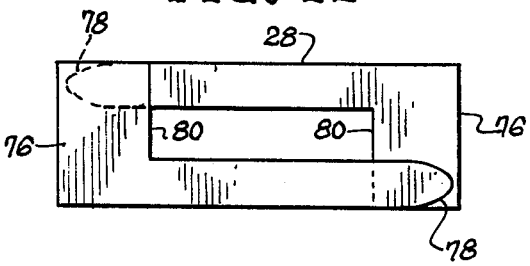
FIG. 12
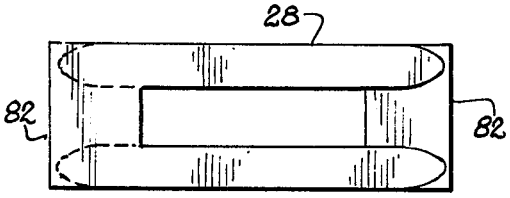
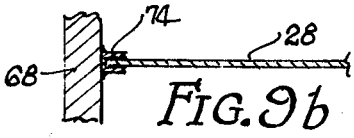
FIG. 9b

SHIELDED TRANSFORMER

BACKGROUND OF THE INVENTION

This invention relates to electrostatically shielded transformers of the type particularly used as isolation transformers to isolate sensitive electrical and electronic equipment from the voltage variations caused by electromagnetic and electrostatic interference, the interference signals being superimposed on the voltage signal supplied with power lines by public utilities. An isolation transformer, by itself, makes no attempt to regulate the amplitude of the supplied voltage signal, but does attenuate interference signals that generally are of a higher frequency and often of a transient nature.

Interference can be caused by equipment belonging to other users of the power line, by electromagnetic or electrostatic fields from many kinds of equipment including electric welding machines, diathermy machines, automotive ignition systems, by lightning, and by various discharges in the power line equipment.

The isolation transformer particularly attenuates common-mode interference. Variations in voltage caused by common-mode interference are equal in amplitude and phase with respect to ground on both lines of the power line pair. These variations are not transmitted from primary winding to secondary winding by normal inductive transformer action because there is no variation in voltage across the primary winding. They are, however, transmitted from primary to secondary in direct proportion to the capacitance between primary and secondary windings. The common-mode interference currents, being alternating currents, flow through this capacitance and eventually back to ground through the load when grounded; or through various capacitances between parts of the secondary winding and ground, and through the capacitance between the load and ground. This is, of course, objectionable.

Isolation transformers using present art place a metallic shield between primary and secondary windings, and ground the shield. Common-mode interference currents will then flow through the primary-to-shield capacitance to ground, providing isolation for the secondary winding and its load from the common-mode interference on the primary.

The primary and secondary windings are fabricated separately. They are then assembled with a multiplicity of ferromagnetic laminations that make up the core. The laminations may be stacked individually, some portions passing through the centers of the windings, or they may be preassembled in pieces that are placed through the centers of the windings and held in place by metallic bands. In any case the primary and secondary windings encircle some portion of the core, passing through at least one opening in the core. The opening is called a window.

The metallic shield is then inserted between the primary and secondary windings, the shield extending both inside and outside the windows in the core. Often metallic end bells around the windings where they are not within the windows in the core. Typically four bolts passing through holes in the laminations and the end bells hold the transformer together.

Generally the fit between the metallic shield and the faces of the windows in the core is poor. In the interest of economy, loose dimensional tolerances are used for the core, the windings, and the shield. The shield must be fairly rigid (typically 2.5 millimeters thick) so that it can be inserted without breaking up or being deformed. A thick shield is undesirable because as the spacing between primary and secondary windings increases, leakage inductance increases causing a degradation in no-load to full-load voltage regulation.

In most core configurations, the faces of the windows comprise the edges of a multiplicity of stacked laminations. The shield butts up against what amounts to a saw-tooth surface. The poor fit between the metallic shield and the faces of the windows in the core causes gaps through which unintercepted electrostatic field lines extend between the primary and secondary windings. These gaps cause a capacitance, of small but important magnitude, to exist between primary and secondary windings. Furthermore the capacitance is highly variable between specimens assembled on the same production line.

This residual capacitance directly between the primary and secondary windings has been called interwinding capacitance by manufacturers of isolation transformers. Although this term does not appear in standard electronics dictionaries, it is useful and descriptive and will be used here.

Interwinding capacitance is determined by applying a measured common-mode, alternating current voltage between the shorted primary winding and ground. The voltage between the secondary and ground across a known impedance is measured, with the secondary winding shorted out, and the shield grounded. The capacitance is then calculated with elementary circuit theory, using the two voltage measurements, and the known values of applied frequency and load impedance.

Isolation transformers using present art are rated according to interwinding capacitance. The lower the capacitance, the better the isolation, and the higher the price. Typical quality classes are 0.005, 0.001, and 0.0005 picofarads. There is a need and a market for isolation transformers with much lower interwinding capacitance.

SUMMARY OF THE INVENTION

The major object of this invention is to provide shielded isolation transformers having greatly reduced interwinding capacitance without an appreciable increase in cost.

Metallic overlap is provided at the juncture of the metallic shield and faces of the windows in the core. This metallic overlap is tolerant to misalignments and variations in fit, completely eliminating gaps that cannot be economically made small with the butt joint of present art.

Providing this first overlap reduces interwinding capacitance by at least a factor of 10. Now another source of capacitance, due to fringing of the electrostatic field at the edges of the metallic shield outside of the windows in the core, becomes measurable. Therefore the metallic shield where not within the windows in the core is extended to the metallic case. Often this is only to the end bell portions of the case. Whatever the configuration of the case, metallic overlap is provided at the juncture of the metallic shield and the metallic case. Providing this second overlap reduces interwinding capacitance by at least another factor of 10.

In a preferred implementation, the metallic overlap at the juncture of the metallic shield and the faces of the windows in the core is provided by extending the shield into grooves formed in the faces of the windows. These grooves comprise notches in the appropriate laminations of the core. The notches are rectangular and need be no larger than 3.0 millimeters on a side. Since laminations are normally stamped out of sheet stock, a small alteration of the stamping die provides the desired notched laminations and grooved core at essentially no increase in cost.

With this implementation, the metallic overlap at the juncture of the metallic shield and the metallic case is provided by extending the shield into grooves formed in the metallic case. When the case comprises outer faces of the core and two end bells, this is economically provided by using grooved extrusions or castings as end bells.

In another implementation, which may be preferred in certain constructions, either totally or in combination with the above implementation, the metallic overlap is provided by extending the metallic shield into grooves formed in channel pieces attached to faces of the windows in the core and to the metallic case. The channel pieces are attached to the faces of the windows with electrically conductive adhesive to preclude any gaps between the channels and the faces. The attachment of the channels to the metallic case may be aided or accomplished with screws.

Another object of this invention is to provide a thinner metallic shield so that the spacing between primary and secondary windings can be reduced, with a resultant reduction in leakage inductance. With the grooves of this invention providing alignment, shields of between 0.1 millimeters and 0.3 millimeters thick can be inserted between the windings without danger of breaking or deforming the shield.

BRIEF DESCRIPTION OF THE DRAWINGS

FIG. 7*a* is a side elevation section view of the isolation transformer of FIG. 6 taken approximately along line 7—7 of FIG. 6;

FIG. 8*a* is a side elevation section view of the isolation transformer of FIG. 6 taken approximately along line 8—8 of FIG. 6;

FIG. 9*a* is a plan section view of the isolation transformer of FIG. 6 taken approximately along line 9—9 of FIG. 6;

FIG. 10 is a front elevation section view of the isolation transformer of FIG. 6 taken approximately along line 10—10 of FIG. 7*a*, shield removed;

FIGS. 7*b*, 8*b*, and 9*b* are expanded views of FIGS. 7*a*, 8*a*, and 9*a*, respectively, showing differences between the first transformer implementation of FIGS. 4*a*, 4*b*, 5, 6, 7*a*, 8*a*, and 9*a*, and a second transformer implementation exemplified by FIGS. 7*b*, 8*b*, and 9*b;*

FIG. 11 is a plan view of the metallic shield, here comprising two L-shaped members; and FIG. 12 is a plan view of the metallic shield, here comprising two U-shaped members.

DETAILED DESCRIPTION

Figure 1:
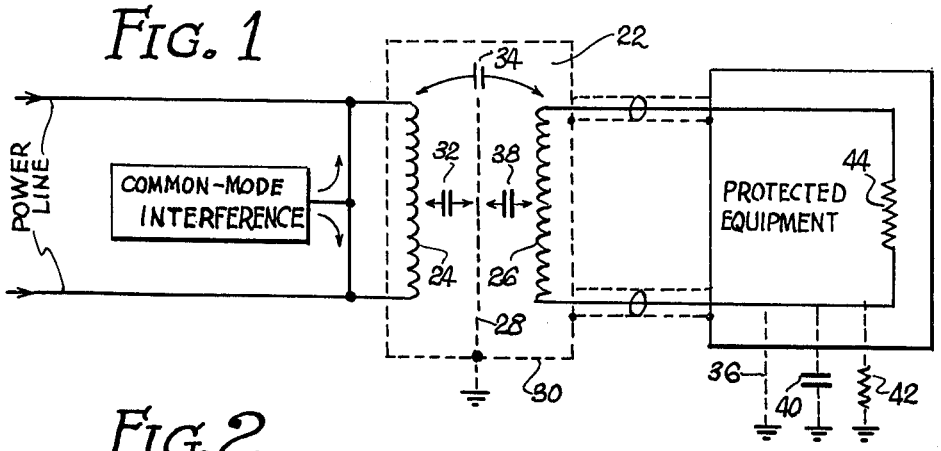
FIG. 1 is an electrical schematic showing a shielded isolation transformer connected between power line and protected equipment.

FIG. 1 illustrates an electrical schematic of a typical shielded transformer 22, used as an isolation transformer connected between the power line and the equipment to be protected. The transformer 22 comprises a primary winding 24, a secondary winding 26, a metallic shield 28, and a metallic case 30.

Common-mode interference currents, being alternating currents, flow through the primary-to-shield capacitance 32 to ground. The currents also flow through the interwinding capacitance 34 and eventually back to ground; through the load when the grounded 36, or through the secondary-to-shield capacitance 38, the capacitance between load and ground 40, and the leakage resistance between load and ground 42.

With a given common-mode noise voltage at the primary winding, the magnitude of the noise current through the interwinding capacitance 34, and thus the load 44, is directly proportional to the interwinding capacitance 34. This is because the impedance to ground in series with the interwinding capacitance is, in all cases, extremely low compared to the reactance of the interwinding capacitance 34. Clearly the lower the value of interwinding capacitance 34, the better the isolation.

Figure 2:
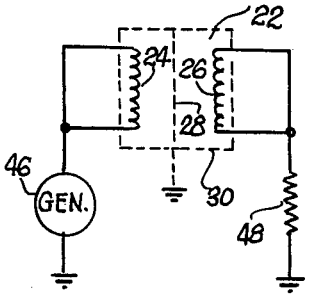
FIG. 2 is an electrical schematic showing a test configuration for measuring interwinding capacitance of an isolation transformer.

FIG. 2 shows a typical test configuration for measuring interwinding capacitance (34 of FIG. 1) by taking voltage measurements and calculating the capacitance using elementary circuit theory. A measured, common-mode, alternating current voltage from a voltage generator 46 is applied between the shorted primary winding 24 and ground. The voltage between secondary winding 26 and ground across a measurement load 48 is measured, with the secondary winding shorted out, and the shield grounded.

Comparing FIG. 2 with FIG. 1, the following can be recognized: (1) the primary-to-shield capacitance 32 does not load the generator 46 and hence can be ignored because its reactance that shunts the generator is very large compared to the internal impedance of the generator; (2) the secondary-to-shield capacitance 38 can be ignored because its reactance is very large compared to the resistance of the measurement load 48; and (3) with the load left ungrounded 36, the leakage resistance between load and ground 42 and the capacitance between load and ground 40 can be ignored because their impedances are very large compared to the resistance of the measurement load 48.

Figure 3:
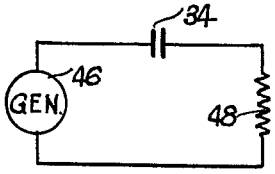
FIG. 3 is an electrical schematic showing an equivalent circuit for the test configuration of FIG. 2.

With these approximations, the equivalent circuit of FIG. 3 can be used for the test configuration of FIG. 2. Considering that the reactance of the interwinding capacitance 34 is very high compared to the resistance of the measurement load 48, the interwinding capacitance in farads, from elementary circuit theory, is equal to the voltage across the measurement load 48, divided by the product of the voltage across the generator 46, the resistance in ohms of the measurement load 48, and the alternating current frequency of the generator expressed in radians per second. In spite of all of these approximations, the error in measurement can readily be less than five percent.

Figure 4A:
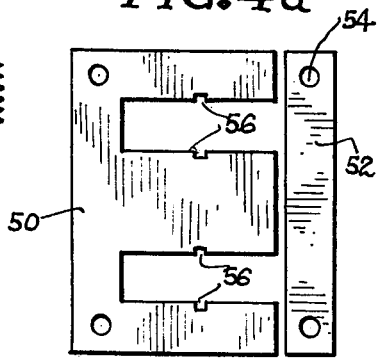
FIG. 4*a* is a plan view of a layer of laminations typical of layers to be stacked as alternate layers to form a core to be used in an isolation transformer in accordance with the present invention.

Turning now to the mechanical structure of an isolation transformer in accordance with the present invention, FIG. 4*a* shows a layer of laminations comprising an E lamination 50 on the left and an I lamination 52 on the right. Four holes 54 are provided through which mounting bolts will pass. Notches 56 are provided as shown. These notches are rectangular, generally less than 3.0 millimeters on a side, and are equidistant from the left and right sides of the layer. This layer is typical of layers to be stacked as alternate layers in forming a core.

Figure 4B:
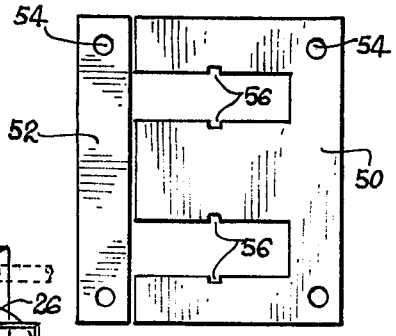
FIG. 4*b* is a plan view of another layer of laminations typical of layers to be stacked in between the layers of FIG. 4*a* to form said core.

FIG. 4*b* shows a layer of laminations comprising an E lamination 50 on the right and an I lamination 52 on the left. The E and I laminations in this layer are identical to the E and I laminations in FIG. 4*a*. This layer is typical of layers to be stacked in between the layers of FIG. 4*a* in forming the core.

Figure 5:
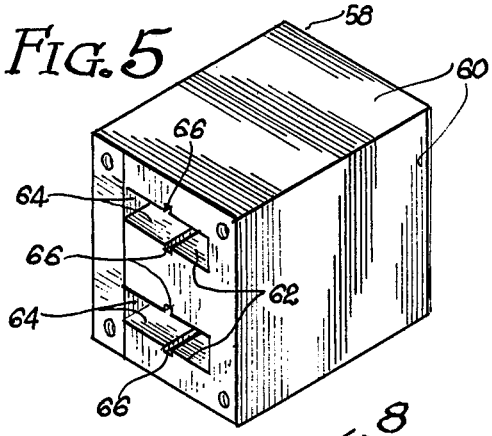
FIG. 5 is a perspective view of the core stacked with the lamination layers of FIGS. 4*a* and 4*b;*

FIG. 5 shows the core 58 stacked with the lamination layers of FIGS. 4*a* and 4*b*. Outer faces 60 of the core form part of the metallic case (30 of FIG. 1) of the transformer. Two windows 62 extend through the core 58. Each window 62 has four faces 64 within the core 58. The notches in laminations 56 of FIGS. 4*a* and 4*b* become grooves 66 in the faces 64 of the windows 62 in the core 58.

Figure 6:
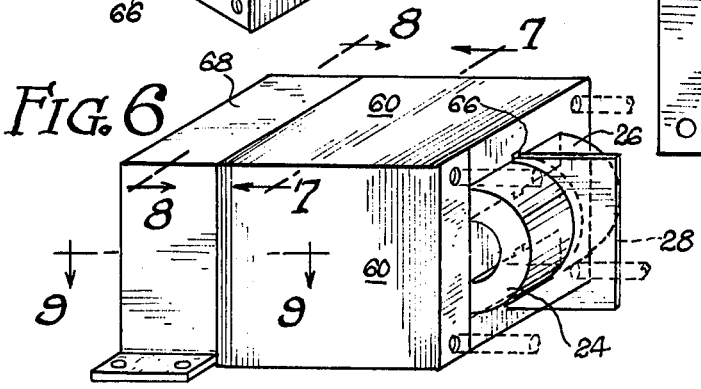
FIG. 6 is a perspective view of an isolation transformer constructed in accordance with the present invention comprising the core of FIG. 5, primary and secondary windings, metallic shield, and end bells, one of which is removed.

FIG. 6 shows an isolation transformer comprising the core 58 of FIG. 5, the primary winding 24, the secondary winding 26, the metallic shield 28, and end bells 68, one of which is removed to show details of the windings and the shield. The outer faces 60 of the core and the end bells 68 compose the metallic case (30 of FIG. 1) that surrounds the primary and secondary windings.

The primary winding 24 and the secondary winding 26 encircle a portion of the core passing through two windows (62 of FIG. 5) in the core 58. The metallic shield 28 is placed between the primary winding 24 and the secondary winding 26, including within the windows 62 in the core 58, the shield intercepting any possible electrostatic field line between any point on the primary winding and any point on the secondary winding.

Considering the metallic shield 28 in more detail, and referring to FIGS. 5, 6, and 7*a*, the shield extends into the grooves 66 in the faces 64 of the windows 62 in the core 58 to provide a metallic overlap at the juncture of the metallic shield 28 and faces 64 of the windows 62 in the core 58.

FIGS. 8*a* and 9*a* show how the metallic shield 28 extends into grooves 70 in the end bells 68 to provide a metallic overlap at the juncture of the metallic shield 28 and the metallic case 30.

FIG. 10 is included to further illustrate the transformer of FIGS. 6, 7*a*, 8*a*, and 9*a*.

FIGS. 7*b*, 8*b*, and 9*b*, modified portions of FIGS. 7*a*, 8*a*, and 9*a*, respectively, illustrate another implementation of the metallic overlap principle. The metallic shield 28 extends into grooves in channel pieces 72 attached to faces 64 of the windows 62 in the core 58 with electrically conductive adhesive. The shield also extends into grooves in channel pieces 74 attached to the end bells 68.

The metallic shield 28 normally comprises two overlapping members insulated from each other so as not to create a "shorted turn" around a portion of the core. The members are inserted between the windings after the laminations and the windings are assembled to become the core and windings.

The shield members can be made of any high conductivity metal but usually of aluminum or copper with copper preferred due to its higher electrical conductivity, a safety consideration in regard to catastrophic shorting to ground such as experienced in a lightning strike.

FIG. 11 shows conventional L-shaped members 76 composing the metallic shield 28. The narrow ends 78 of the members are rounded and tapered to make insertion easier. Edges 80 that butt up against the core are covered with metallic tape so as to avoid any gap between the shield 28 and the core 58.

FIG. 12 shows an alternative implementation using two U-shaped members 82 composing the metallic shield 28. All four long edges of each member are slightly over cut into the metal by the same amount. This facilitates an easy insertion. Each member is made snug in two of the grooves. By sliding the two members into the grooves in opposite directions a snug fit is obtained in all four grooves.

With the grooves of this invention providing alignment and the shield members just described, shields of between 0.1 and 0.3 millimeters thick can be inserted between the windings without danger of breaking or deforming the shield. This can result in a reduced spacing between primary and secondary windings, and a resultant reduction in leakage inductance and hence better no-load to full-load voltage regulation.

The preferred embodiment of FIGS. 4*a* through 12 shows a physical configuration highly influenced by the selection of the E-I laminations for the core. While this core configuration is often used in shielded isolation transformers, it is by no means the only configuration used. Similarly the innovations and novelty of this invention as expressed in the claims are not limited to transformers with E-I laminations. A person skilled in the art can readily extend the teachings here to other core geometries.

What is claimed is:

1. A shielded transformer comprising:

(a) a core with at least one window, said core being composed of multiple ferromagnetic laminations;

(b) a primary winding encircling a portion of said core and passing through one window in said core;

(c) a secondary winding encircling a portion of said core and passing through said core;

(d) a metallic case enclosing said primary and secondary windings, said case including outer faces of said core and surrounding said primary and secondary windings where the windings extend outside said window in said core;

(e) a metallic shield between said primary and secondary windings, said shield being in said window in said core, said shield having a juncture with edges of the faces of said window and intercepting any possible electrostatic field line between any point on said primary winding and any point on said secondary winding; and (f) a metallic overlap extending completely along the length of the juncture of said metallic shield and faces in said core for intercepting electrostatic field lines having a tendency to pass through said juncture, said metallic overlap including conducting wall means on the faces of said window, said wall means having faces against which a face of the shield abuts.

2. The shielded transformer of claim 1 wherein said windows have grooves in said faces of the windows to form said faces of said wall means, said shield having edges extending into said grooves.

3. The shielded transformer of claim 1 wherein said metallic overlap at the juncture of said metallic shield and faces of said window in said core comprises channel pieces attached to faces of the windows in said core with electrically conductive adhesive, said channel pieces having grooves to form said face of said wass means, said metallic shield extending into said grooves.

4. A shielded transformer according to claim 1 wherein said metallic shield is less than 0.3 millimeters thick.

5. A shielded transformer comprising:

(a) a core having at least one window, said core being composed of multiple ferromagnetic laminations;

(b) a primary winding encircling a portion of said core and passing through one of said windows in said core;

(c) a secondary winding encircling a portion of said core and passing through said window in said core;

(d) a metallic case enclosing said primary and secondary windings, said case comprising outer faces of said core and surrounding said primary and secondary windings where the windings extend outside said window in said core;

(e) a metallic shield between said primary and secondary windings, said shield being in the window in said core, said shield intercepting any possible electrostatic field line between any point on said primary winding and any point on said secondary winding and, where not within said core, extending to said metallic case;

(f) a first metallic overlap extending completely along the length of a first juncture of said metallic shield and said faces of said core window for intercepting electrostatic field lines having a tendency to pass through said first juncture;

(g) a second metallic overlap extending completely along a second juncture of the metallic shield and the metallic case for intercepting electrostatic field lines having a tendency to pass through said second juncture;

(h) said first metallic overlap including first wall means on said window faces for receiving said shield, said second metallic overlap including further wall means on said metallic case for receiving said shield, each of said wall means having faces against which a face of the shield abuts.

6. The shielded transformer of claim 5 wherein said first metallic overlap comprises first grooves formed in faces of said windows to form said faces of said first wall means, said shield extending into said first grooves, said second metallic overlap comprising second grooves formed in said metallic casing to form said faces of said further wall means, said shield extending into said second grooves.

7. The shielded transformer of claim 5 wherein said first metallic overlap comprises first channel pieces attached to said faces of said window in said core to form said faces of said first wall means, said shield extending into said first channel pieces, said second metallic overlap comprising further channel pieces attached to said metallic case to form said faces of said second wall means, said shield extending into said further channel prices.

8. A shielded transformer according to claim 5 wherein said metallic shield is less than 0.3 millimeters thick.

* * * * *